US006657376B1

(12) United States Patent
Raina et al.

(10) Patent No.: US 6,657,376 B1
(45) **Date of Patent: *Dec. 2, 2003**

(54) ELECTRON EMISSION DEVICES AND FIELD EMISSION DISPLAY DEVICES HAVING BUFFER LAYER OF MICROCRYSTALLINE SILICON

(75) Inventors: Kanwal K. Raina, Boise, ID (US); Ammar Derraa, Boise, ID (US)

(73) Assignee: Micron Technology, Inc., Boise, ID (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/323,557

(22) Filed: Jun. 1, 1999

(51) Int. Cl.[7] ..... H01J 1/62; H01J 63/04

(52) U.S. Cl. ..... 313/496; 313/495; 313/309; 313/336

(58) Field of Search ..... 313/496, 495, 313/497, 309, 336, 351

(56) References Cited

U.S. PATENT DOCUMENTS

| | | | | |
|---|---|---|---|---|
| 4,517,226 | A | 5/1985 | Baldi et al. | 427/90 |
| 4,525,733 | A | 6/1985 | Losee | 357/65 |
| 4,556,897 | A | 12/1985 | Yorikane et al. | 357/71 |
| 4,561,009 | A | 12/1985 | Yonezawa et al. | 357/67 |
| 4,786,962 | A | 11/1988 | Koch | 357/71 |
| 4,899,206 | A | 2/1990 | Sakurai et al. | 357/67 |
| 4,942,138 | A | 7/1990 | Miki | 437/182 |
| 5,106,781 | A | 4/1992 | Penning De Vries | 437/192 |
| 5,313,100 | A | 5/1994 | Ishii et al. | 257/751 |
| 5,393,565 | A | 2/1995 | Suzuki et al. | 427/255.2 |
| 5,399,236 | A | 3/1995 | Ha et al. | 156/643 |
| 5,406,121 | A | 4/1995 | Toyoda | 257/740 |
| 5,449,640 | A | 9/1995 | Hunt et al. | 437/190 |
| 5,470,792 | A | 11/1995 | Yamada | 437/155 |
| 5,587,339 | A | 12/1996 | Wyborn et al. | 437/195 |
| 5,594,297 | A | 1/1997 | Shen et al. | 313/309 |
| 5,641,703 | A | 6/1997 | Cohen et al. | 438/467 |
| 5,656,886 | A * | 8/1997 | Westphal et al. | 313/495 |
| 5,691,787 | A | 11/1997 | Shimada et al. | 349/40 |
| 5,696,387 | A | 12/1997 | Choi et al. | 257/57 |

(List continued on next page.)

FOREIGN PATENT DOCUMENTS

EP 0 112 417 A1 12/1982

OTHER PUBLICATIONS

*Japan Patent Information Organization DIALOG® Journal*; Section: P, Section No. 584, Vol 11, No. 178, p. 41, Jun. 9, 1987.

U.S. patent application Ser. No. 09/096,085, Raina et al., filed Jun. 11,1998.

*Primary Examiner*—Vip Patel
*Assistant Examiner*—Kevin Quarterman
(74) *Attorney, Agent, or Firm*—Wells St. John P.S.

(57) ABSTRACT

In one aspect, an electron emission device comprises a substrate, and a first layer supported by the substrate. The first layer comprises a conductive material. The electron emission display device further comprises an electron emission tip electrically connected with the first layer, and a second layer electrically disposed between the first layer and the electron emission tip. The second layer comprises microcrystalline silicon. In another aspect, the invention encompasses a method of forming an electron emission device. A substrate is provided, and a conductive layer is formed over the substrate. A microcrystalline-silicon-containing layer is formed over the conductive layer, and a resistor layer is formed over the microcrystalline-silicon-containing layer. An emitter tip is formed over the resistor layer. In yet other aspects, the invention encompasses field emission display devices, and methods of forming field emission display devices.

19 Claims, 5 Drawing Sheets

U.S. PATENT DOCUMENTS 5,751,272 A 5/1998 Silverbrook et al. ..... 345/149
6,015,323 A * 1/2000 Moradi et al. ..... 445/24
6,064,149 A 5/2000 Raina ..... 313/497
6,120,338 A 9/2000 Hirano et al. ..... 445/24
6,176,752 B1 * 1/2001 Tjaden et al. ..... 445/24
6,211,608 B1 4/2001 Raina et al. ..... 313/309

* cited by examiner

ELECTRON EMISSION DEVICES AND FIELD EMISSION DISPLAY DEVICES HAVING BUFFER LAYER OF MICROCRYSTALLINE SILICON

PATENT RIGHTS STATEMENT

This invention was made with Government support under Contract No. DABT63-97-C-0001 awarded by Advanced Research Projects Agency (ARPA). The Government has certain rights in this invention.

TECHNICAL FIELD

The invention pertains to electron emission devices. In particular applications, the invention pertains to methods of forming and utilizing buffer layers between resistive materials and conductive lines for field emission display devices.

BACKGROUND OF THE INVENTION

Electron emission devices include display devices wherein electrons are emitted from cathode emitter tips toward phosphor molecules (the phosphor molecules can also be referred to herein as simply "phosphor"). An exemplary display device is a Field Emission Display (FED) device, such as the prior art FED device 10 described with reference to FIG. 1. Device 10 comprises a baseplate assembly 12 and a faceplate assembly 14.

Baseplate assembly 12 includes a substrate 16, column interconnects 18, a buffer layer 19, a resistor layer 20, electron emission tips 22, an extraction grid 24 and a dielectric layer 26.

Substrate 16 is preferably formed of an insulative glass material, and can be referred to as a baseplate. Column interconnects 18 are patterned over substrate 16. Column interconnects 18 comprise a conductive material, such as, for example, a metal. In preferred applications, column interconnects comprise an assembly of three sub-layers, with the sub-layers being an aluminum layer elevationally between a pair of chromium layers.

Buffer layer 19 is formed over column interconnects 18, and resistor layer 20 is formed over buffer layer 19. Buffer layer 19 comprises amorphous silicon, and resistor layer 20 comprises conductively-doped amorphous silicon (preferably, boron-doped amorphous silicon).

Electron emission tips 22 are formed over substrate 16 at sites from which electrons are to be emitted, and can be constructed from conductively doped amorphous silicon. Emission tips 22 can have a number of pointed geometries, including, for example, pyramids and cones.

Extraction grid 24 (also referred to as a gate), is formed proximate emitter tips 22, and separated from substrate 16 with dielectric layer 26. Extraction grid 24 comprises a conductive material, such as, for example, conductively doped polysilicon. Extraction grid 24 is patterned to have openings 28 extending therethrough to expose electron emission tips 22. Dielectric layer 26 electrically insulates extraction grid 24 from electron emission tips 22, and the associated column interconnects 18.

Faceplate assembly 14 of FED device 10 is provided in a spaced relation relative to baseplate assembly 12, and is held in such spaced relation by insulative spacers 38.

Faceplate assembly 14 comprises a transparent substrate 36, and a transparent anode 34 formed proximate substrate 36. Substrate 36 can be referred to as a faceplate. Anode 34 can comprise, for example, indium tin oxide, and substrate 36 can comprise, for example, glass.

Faceplate assembly 14 comprises phosphor 32 supported by substrate 36 and defining pixels. Phosphor 32 comprises a luminescent material that generates visible light upon being excited by electrons emitted from electron emission tips 22. Phosphor 32 can comprise, for example, red/green/blue phosphor triads.

A voltage source 30 is provided to generate an operating voltage differential between electron emission tips 22, grid structure 24, and anode 34. One or more of emitter tips 22 can then be electrically stimulated to cause electrons 40 to be emitted toward phosphor 32. The impact of electrons 40 with phosphor 32 causes luminescence of phosphor 32. A person looking through transparent substrate 36 can see such luminescence. Accordingly, electron emission from emitter tips 22 is converted to an image visible through faceplate assembly 14.

FIGS. 2 and 3 illustrate alternative views of the baseplate assembly 12 of FED device 10, and show that electron emission tips 22 are grouped into discrete emitter sets 42, with the bases of the electron emission tips in each set being electrically connected to a common conductive interconnect 18. Further, FIG. 3 shows that emitter sets 42 are configured into columns (labeled as $C_1$ and $C_2$), with the individual emitter sets 42 in each column being connected to a common electrical interconnection. FIG. 3 also shows that the extraction grid 24 is divided into grid structures 25, with each emitter set 42 being associated with a different grid structure than the other emitter sets 42. In the shown embodiment, grid structures 25 are portions of extraction grid 24 that lie over a corresponding emitter set 42 and have openings 28 formed therethrough. Grid structures 25 are arranged in rows (labeled $R_1$–$R_3$) in which the individual grid structures in each row are connected to a common electrical connection.

In referring to columns and rows above, the term "columns" is used to describe an arrangement of electron emission tips, and the term "rows" is used to describe an arrangement of grid structures, as is a conventional use of such terms. However, it is to be understood that the terms can be reversed in particular applications.

The arrangement of the grid structures in rows $R_1$–$R_3$ and the emitter sets in columns $C_1$ and $C_2$ defines an x-y addressable array of grid-controlled emitter sets. The two terminals, comprising the electron emission tips 22 and the grid structures, of the three terminal cold cathode emitter structure (where the third terminal is anode 34 in faceplate assembly 14 of FIG. 1) are commonly connected along such columns and rows, respectively, by means of high-speed interconnects. In particular, column interconnects 18 are formed over substrate 16, and row interconnects 44 are formed over the grid structures.

In operation, a specific emitter set is selectively activated by producing a voltage differential between the specific emitter set and the associated grid structure. The voltage differential may be selectively established through corresponding drive circuitry that generates row and column signals that intersect at the location of the specific emitter set. Referring to FIG. 3, for example, a row signal along $R_2$ of the extraction grid 24 and a column signal along $C_1$ of emitter set 42 activates the emitter set at the intersection of row $R_2$ and column $C_1$. The voltage differential between the grid structure and the associated emitter set produces a localized electric field that causes emission of electrons from the activated emitter set.

Early field emission devices were assembled without resistor layer 20 and suffered from uneven emission between different electron emission tips 22, with the result that noticeably bright and dim spots were produced on the screens of the flat panel displays. The problem of uneven emission was significantly reduced by including resistor layer 20, shown in FIGS. 1 and 2, between column interconnects 18 and electron emission tips 22. Resistor layer 20 can act as a ballast against excessive current through electron emission tips 22, thereby making electron emission roughly uniform among different electron emission tips. Moreover, in the absence of resistor layer 20, short circuiting between column interconnects 18 and row interconnects 44 was sometimes observed.

Problems can, however, be associated with the resistor layer 20. For instance, resistor layer 20 is found to occasionally have "pinhole" defects or other discontinuities, which can lead to breakdown of the resistor layer. Accordingly, buffer layer 19 was developed to be inserted between conductive interconnects 18 and resistor layer 20. Buffer layer 19 generally comprises undoped amorphous silicon, and is formed through plasma enhanced chemical vapor deposition (PECVD) of silane in an atmosphere having a temperature of less than 400° C., a pressure in a range of from about 500 mTorr to about 1,200 mTorr, and an operating power in a range of from about 200 watts to about 500 watts. Most preferably, the PECVD is conducted at a temperature of less than about 350° C. The silane can be introduced at a rate in a range of from about 500 standard cubic centimeters per minute (sccm) to about 800 sccm, and buffer layer 19 is preferably formed to a thickness in a range of from about 200 Angstroms to about 1,000 Angstroms, with a preferred thickness being from about 800 Angstroms to about 1,000 Angstroms.

Buffer layer 19 provides a protective layer between resistor layer 20 and conductive interconnect 18. For instance, if discontinuities (such as, for example, pinholes) are formed within resistor layer 20, such discontinuities will terminate on buffer layer 19, rather than extending to conductive interconnect 18. Buffer layer 19 can thus avoid shorting that would otherwise occur in the absence of buffer layer 19.

While buffer layer 19 alleviates many of the problems associated with prior art devices lacking buffer layer 19, problems have been found to occur in utilizing the above-described buffer layer 19. For instance, in preferred applications in which conductive layer 18 comprises a sandwich of chromium, aluminum and chromium sub-layers, it is found that the above-discussed buffer layer 19 can have poor adhesion to an outer chromium surface of the conductive interconnect 18. It would, therefore, be desirable to develop alternative buffer layers. It would also be desirable to develop methods for incorporating such alternative of buffer layers into electron emission devices, such as, for example, field emission display devices.

SUMMARY OF THE INVENTION

In one aspect, an electron emission device comprises a substrate, and a first layer supported by the substrate. The first layer comprises a conductive material. The electron emission display device further comprises an electron emission tip electrically connected with the first layer, and a second layer electrically disposed between the first layer and the electron emission tip. The second layer comprises microcrystalline silicon.

In another aspect, the invention encompasses a method of forming an electron emission device. A substrate is provided, and a conductive layer is formed over the substrate. A microcrystalline-silicon-containing layer is formed over the conductive layer, and a resistor layer is formed over the microcrystalline-silicon-containing layer. An emitter tip is formed over the resistor layer.

In yet other aspects, the invention encompasses field emission display devices, and methods of forming field emission display devices.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
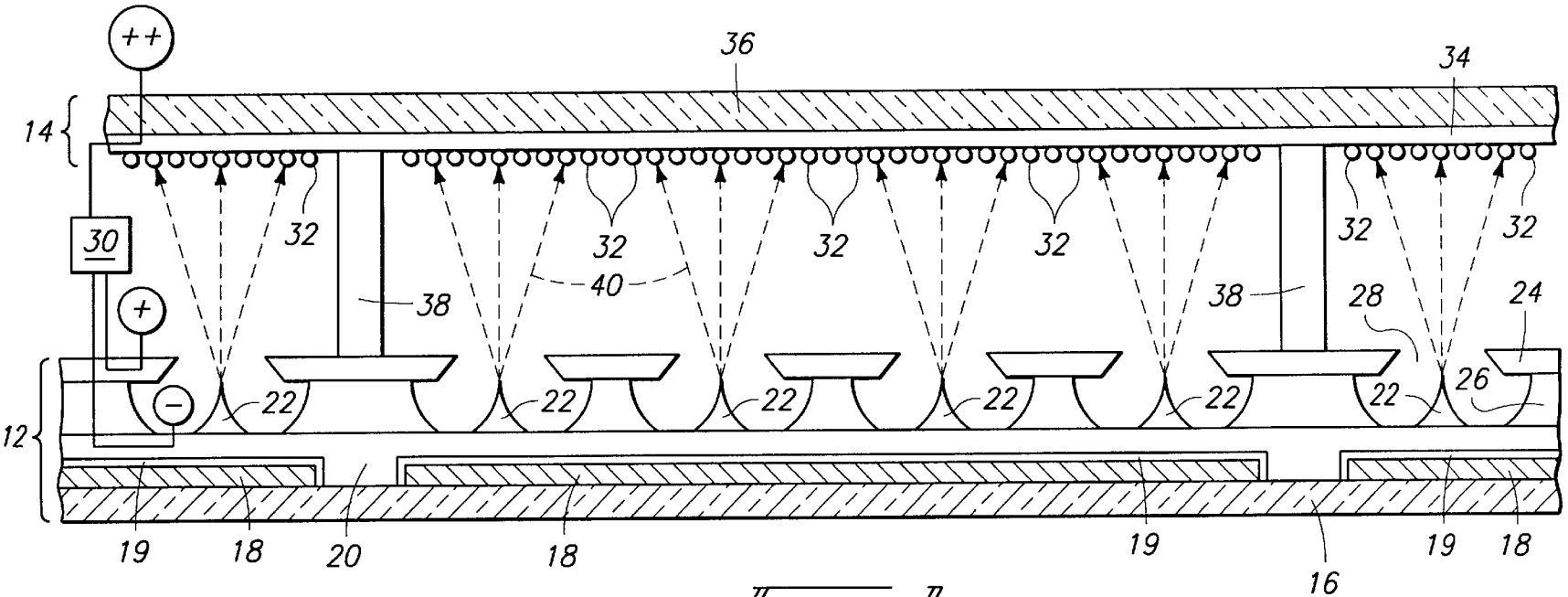
FIG. 1 PRIOR ART
FIG. 1 is a diagrammatic, fragmentary, cross-sectional view of a prior art FED device.
Figure 2:
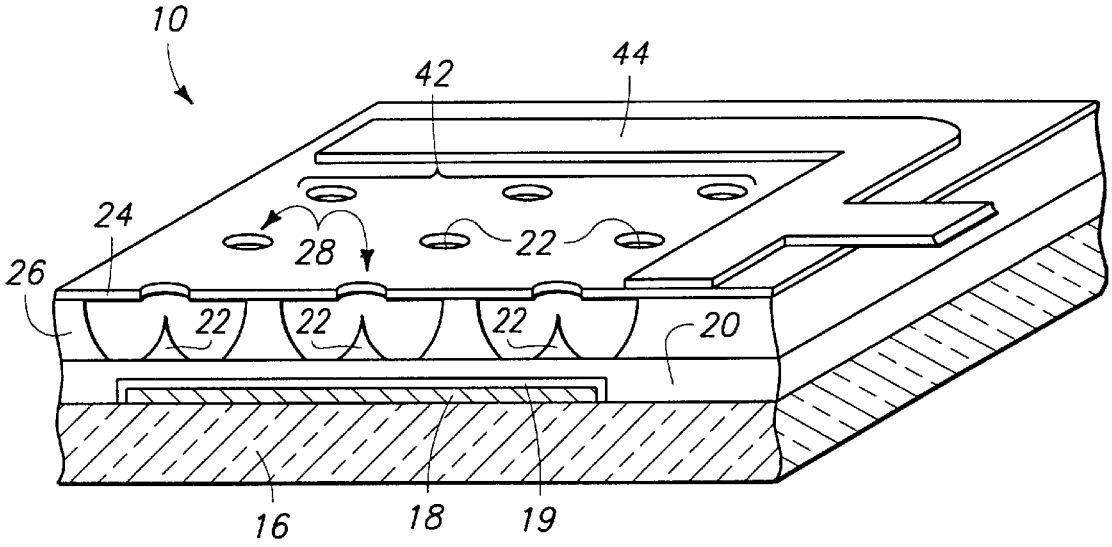
Fig 2 PRIOR ART
FIG. 2 is a fragmentary, perspective view of a baseplate assembly of the prior art FED device of FIG. 1, showing an emitter set comprising a plurality of electron emission tips.
Figure 3:
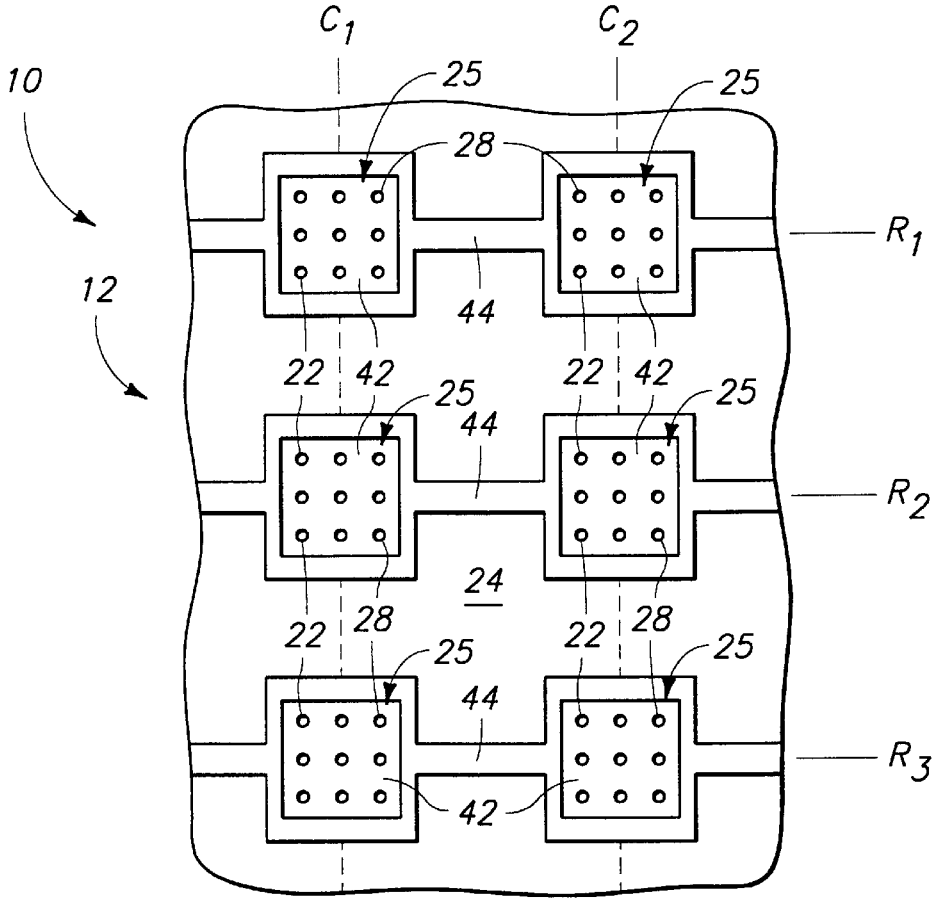
Fig 3 PRIOR ART
FIG. 3 is a top view of a the baseplate assembly of the FIG. 1 FED, showing a larger portion of the baseplate assembly than FIG. 2, and showing addressable rows and columns.

The invention encompasses methods of forming electron emission devices having improved buffer layers, with the buffer layers being improved relative to, for example, the prior art buffer layer 19 described above with reference to FIGS. 1–3.

Figure 4:
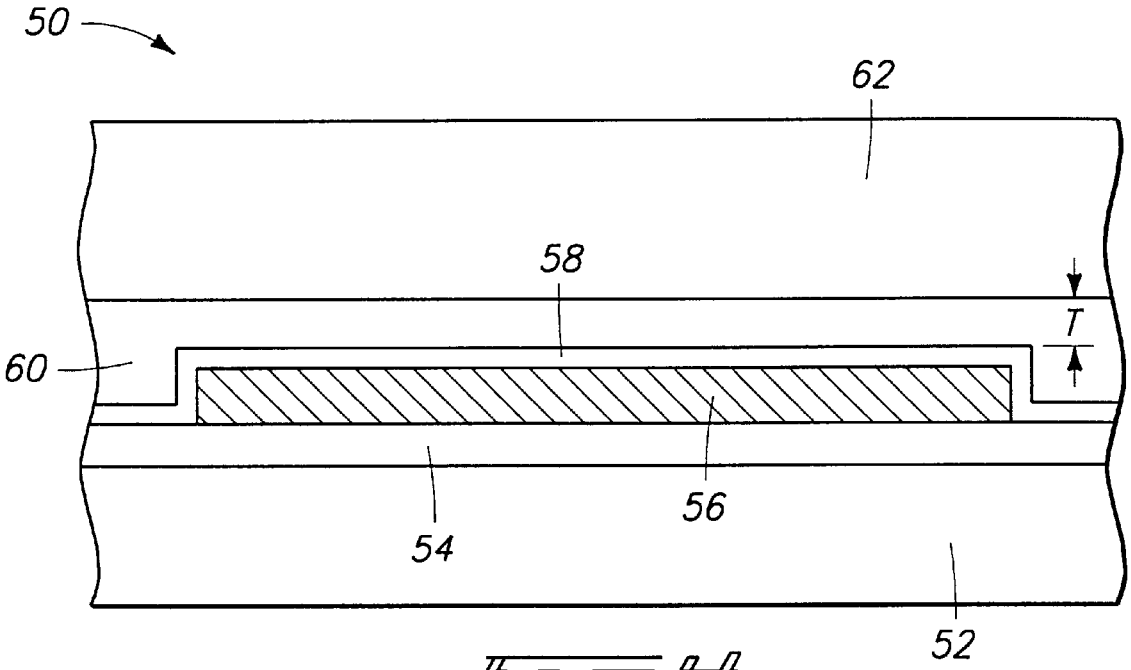
FIG. 4 is a cross-sectional, diagrammatic, fragmentary side view of a baseplate assembly at a preliminary stage of a method of the present invention.

FIG. 4 shows a baseplate assembly 50 at a preliminary processing step in accordance with the method of the present invention. Assembly 50 comprises a substrate (or baseplate) 52 which can be, for example, a glass layer, or a semiconductive material. To aid in interpretation of the claims that follow, the term "semiconductive substrate" or "semiconductor substrate" is defined to mean any construction comprising semiconductive material, including, but not limited to, bulk semiconductive materials such as a semiconductive wafer (either alone or in assemblies comprising other materials thereon), and semiconductive material layers (either alone or in assemblies comprising other materials). The term "substrate" refers to any supporting structure, including, but not limited to, the semiconductive substrates described above.

In particular applications, substrate 52 can comprise a soda-lime glass. Soda-lime glass, which is characterized by durability and relatively low softening and melting temperatures, commonly contains, but is not limited to, silica ($SiO_2$) with lower concentrations of soda ($Na_2O$), lime (CaO), and optionally oxides of aluminum, potassium, magnesium and/or tin. Although substrate 52 is typically electrically insulative, an insulative layer 54 can optionally be formed on substrate 52. Insulative layer 54 limits diffusion of impurities from substrate 52 into overlying layers, and facilitates adhesion of a subsequent layer. Further, the electrically insulative qualities of insulative layer 54 can prevent leakage of current and charge between conductive structures formed thereover. Silicon dioxide is a preferred material for layer 54, and is preferably formed to a thickness in a range of from about 2,000 Angstroms to about 2,500 Angstroms, and is most preferably about 2,000 Angstroms.

A cathode conductive layer 56 is formed over insulative layer 54, and in the shown preferred embodiment is on insulative layer 54. Preferably, cathode conductive layer 56 comprises one or both of chromium and aluminum. More preferably, cathode layer 56 comprises three sub-layers, with the sub-layers constituting an aluminum-containing layer between two chromium-containing layers. The chromium and/or aluminum of cathode conductive layer 56 can be formed by, for example, plasma vapor deposition sputtering. Conductive layer 56 is preferably patterned to form a series of parallel columns.

A buffer layer 58 is formed over both cathode conductive layer 56 and insulative layer 54, and in the shown preferred embodiment is formed on both of cathode conductive layer 56 and insulative layer 54. Buffer layer 58 is preferably formed to a thickness of from about 200 Angstroms to about 600 Angstroms, with a more preferable thickness being about 400 Angstroms. Buffer layer 58 preferably comprises microcrystalline silicon, and in particular aspects of the invention buffer layer 58 consists essentially of microcrystalline silicon or conductively-doped microcrystalline silicon. As utilized herein, microcrystalline silicon is defined as a granular silicon material having crystalline grains, with a predominate portion of the grains having a grain size of from about 100 Angstroms to about 500 Angstroms. In contrast, amorphous silicon is defined as a material, which, to the extent it comprises distinct crystalline grains, comprises a predominate portion of such grains having a grain size of less than 25 Angstroms. Polycrystalline silicon is defined as a granular silicon material having crystalline grains, wherein a predominate portions of the grains have a grain size of greater than 500 Angstroms. A buffer layer of the present invention thus can differ from the above-discussed prior art buffer layer (19 in FIG. 1) by the grain size of the buffer layer of the present invention.

Buffer layer 58 of the present invention further differs from buffer layer 19 of the prior art in the method of formation of buffer layer 58. Specifically, the amorphous silicon of buffer layer 19 is typically formed (as discussed above in the "Background" section) by PECVD. The PECVD can utilize silane and hydrogen as precursor materials, with a ratio of the silane to hydrogen being from about 1:2 to about 1:3 (typically from about 400 sccm to about 500 sccm of silane are utilized, and accordingly typically from about 800 sccm to about 1,500 sccm of hydrogen are utilized). In contrast, PECVD of the microcrystalline silicon of layer 58 utilizes a ratio of silane to hydrogen of from 1:30 to 1:60.

An exemplary PECVD method of forming microcrystalline-silicon-containing layer 58 utilizes a flow rate of silane into a PECVD chamber of from about 50 sccm to about 100 sccm, and a corresponding flow rate of hydrogen into the chamber of from about 1,500 sccm to about 6,000 sccm. In preferred applications, the flow rate of silane into the chamber is about 100 sccm, and the flow rate of hydrogen into the chamber is from about 3,000 sccm to about 6,000 sccm. Other exemplary conditions form forming microcrystalline-silicon-containing layer 58 include a pressure within the chamber of from about 500 mTorr to about 1,200 mTorr, an operating power of from about 200 watts to about 500 watts, and a temperature of less than about 400° C. The temperature is preferably less than 350° C. A particular combination of deposition conditions includes a flow rate of silane of 100 sccm, a flow rate of hydrogen of 4,500 sccm, a power of 700 watts, and a pressure of 1,200 mTorr.

Preferably, advantages of the buffer layer 58 of the present invention relative to prior art buffer layer 19 are, (1) that the buffer layer of the present invention has better adhesion to underlying conductive layer 56 and insulative layer 54, and (2) that a microcrystalline-silicon-containing buffer layer of the present invention can be formed with a greater range of conductivity than can an amorphous silicon buffer layer of the prior art.

Possible mechanisms for the above-described preferred advantages are provided next to assist a reader in understanding the present invention. It is to be understood, however, that the mechanisms are provided only to assist in understanding such aspects, and that the invention is not to be limited to such mechanisms except to the extent that the mechanism is recited in the claims that follow.

A mechanism which can explain why a microcrystalline-silicon-containing buffer layer of the present invention can adhere better to underlying layers than does an amorphous-silicon-containing layer of the prior art is that the extra hydrogen present in a buffer layer of the present invention enhances adherence to underlying layers.

A mechanism which can explain why a buffer layer of the present invention has a wider range of potential conductivity than does an amorphous-silicon-containing buffer layer of the prior art, is that the larger grain size of microcrystalline silicon can accommodate a larger range of conductivity. An exemplary conductivity range of a microcrystalline-silicon-containing layer of the present invention is from about 10 ohms/cm to about 100,000 ohms/cm, with the conductivity being adjusted by implanting conductivity-enhancing dopant into the microcrystalline silicon of the present invention. Higher conductivities are obtained with higher dopant concentrations. The implanted dopant concentration can range from about 0 atoms/$cm^3$ to at least about $10^{20}$ atoms/$cm^3$. In contrast, when amorphous silicon is doped with comparable amounts of dopant, the conductivity range obtained is from about 100 ohms/cm to about 100,000 ohms/cm. Accordingly, the microcrystalline-silicon-containing buffer layer of the present invention gains about a tenfold increase in the obtainable conductivity range over prior art buffer layers.

A potential disadvantage in utilizing a microcrystalline-silicon-containing buffer layer of the present invention relative to an amorphous-silicon-containing buffer layer of the prior art is that the hydrogen present within a microcrystalline-silicon-containing buffer layer of the present invention can increase a compressive stress of the layer relative to the compressive stress of amorphous silicon. For instance, it is found that microcrystalline-silicon-containing layers formed in accordance with the present invention typically have compressive stresses of from about $5\times10^9$ dynes/$cm^2$ to about $7\times10^9$ dynes/$cm^2$, whereas amorphous silicon typically has compressive stresses of from about $1\times10^9$ dynes/$cm^2$ to about $2\times10^9$ dynes/$cm^2$. However, it is found that the compressive stress formed in buffer layers of the present invention are not problematic in ultimately forming electron emission devices.

The microcrystalline-containing-buffer layer of the present invention is advantageous over prior art amorphous-silicon-containing buffer layers for the reasons discussed above. It is noted that a microcrystalline-silicon-containing buffer layer of the present invention can also be advantageous over polycrystalline-silicon-containing buffer layers. Specifically, temperatures of greater than about 550° C. are typically necessary to deposit polycrystalline silicon, and such high temperatures would melt a glass substrate (for instance, 52 of FIG. 4) over which the polycrystalline-containing-silicon buffer layer were formed. In contrast, the microcrystalline-containing-silicon buffer layer of the present invention can be formed at temperatures of less than about 400° C., and is preferably formed at temperatures of less than about 350° C.

Referring again to FIG. 4, a resistor layer 60, preferably comprising boron-doped amorphous silicon, is formed over buffer layer 58, and in the shown preferred embodiment is formed on buffer layer 58. The boron-doped amorphous silicon can be deposited to plasma enhanced chemical vapor deposition in an atmosphere of a mixture of about 800 parts silane and about 2 parts diborane having a temperature less than about 400° C., at a pressure in a range of from about 100 mTorr to about 1,500 mTorr, with the mixture being introduced at a rate preferably greater than 1,200 sccm. Most preferably, the plasma enhanced chemical vapor deposition is conducted at a temperature of less than 350° C.

As cathode conductive layer 56 is ordinarily patterned into columns, the cathode conductive layer is generally not continuous over substrate 52. Accordingly, some portions of resistor layer 60 are positioned over the columns of cathode conductive layer 56, while other portions are not. Preferably, resistor layer 60 is formed such that the portion of resistor layer 60 positioned over cathode conductive layer 56 has a thickness "T" in a range of from about 3,000 Angstroms to about 5,000 Angstroms. It is found that boron-doped amorphous silicon having a bulk resistivity in a range of, for example, from about $1\times10^3$ ohm-cm to about $1\times10^4$ ohm-cm satisfactorily regulates current flow through many completed electron emission devices. By way of example, and not by limitation, resistor layer 60 can be doped with boron at a concentration in the range of from about $1\times10^{19}$ atoms/cm$^2$ to about $1\times10^{20}$ atoms/cm$^2$. It will be understood by those skilled in the art that the ratio of silane to diborane will be determined by the dopant concentration desired, and ultimately, by the desired resistivity of resistor layer 60.

An emitter layer 62 is formed over resistor layer 60, and in the shown preferred embodiment is formed on resistor layer 60. Emitter layer 62 preferably comprises a material having a relatively low work function, so that a low applied voltage will induce a relatively high electron flow from the material. A preferred material for layer 62 is phosphorus-doped amorphous silicon. An exemplary concentration of phosphorus within the phosphorus-doped amorphous silicon is from about $1\times10^{20}$ atoms/cm$^2$ to about $1\times10^{21}$ atoms/cm$^2$.

Figure 5:
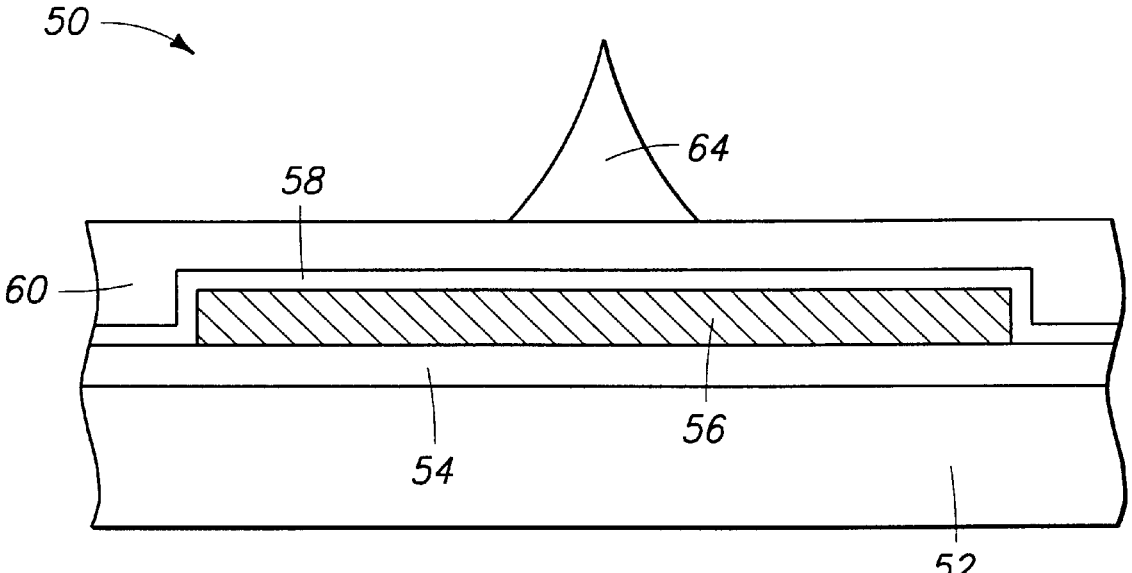
FIG. 5 is a view of the FIG. 4 baseplate assembly shown at a processing step subsequent to that of FIG. 4.

Referring to FIG. 5, an electron emission tip 64 is patterned from layer 62 (FIG. 4). Such patterning can be accomplished by, for example, dry etching. While only one emission tip 64 is shown in FIG. 5, generally an array of tens of millions or more electron emission tips 64 would be patterned from layer 62. Such electron emission tips would typically be grouped together in emitter sets, such as the emitter sets 42 illustrated in prior art FIGS. 2 and 3.

In the embodiment of FIG. 5, electron emission tip 64 is formed directly over conductive cathode layer 56. In alternative constructions, emitter tips 64 can be formed proximate conductive cathode layer 56, but not directly over such conductive cathode layer 56. In either the embodiment shown in FIG. 5, or in alternate embodiments wherein the emission tips 64 are not formed directly over conductive layer 56, emitter tips 64 will be electrically connected with conductive layer 56. Further, buffer layer 58 will be electrically disposed between conductive layer 56 and electron emission tips 64. In the shown preferred embodiment, buffer layer 58 is physically disposed between conductive layer 56 and emission tips 64, as well as being electrically disposed between conductive layer 56 and emission tips 64.

Figure 6:
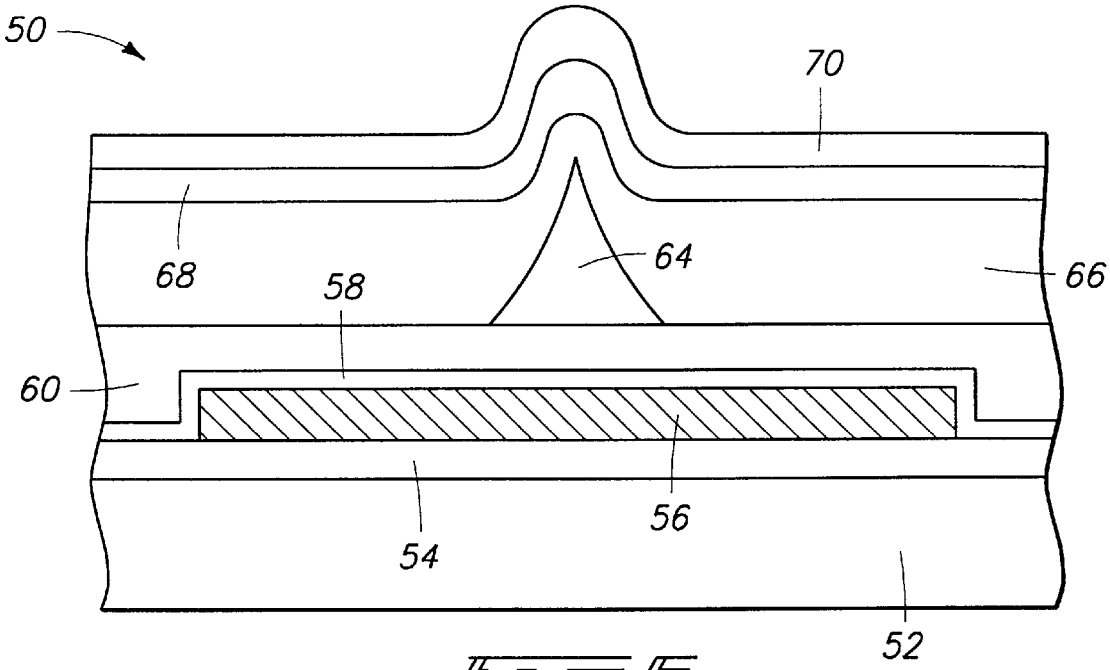
FIG. 6 is a view of the FIG. 4 baseplate assembly shown at a processing step subsequent to that of FIG. 5.

Referring to FIG. 6, a dielectric layer 66 is formed over electron emission tip 64 and resistor layer 60. Dielectric layer 66 can electrically separate electron emission tip 64 and resistor layer 60 from overlying conductive layers. A suitable material for dielectric layer 66 is silicon dioxide.

A gate semiconductive layer 68 is formed over dielectric layer 66. Semiconductive layer 68 can comprise, for example, phosphorus-doped amorphous silicon, with the phosphorus being present at a concentration of from about $1\times10^{20}$ atoms/cm$^2$ to about $1\times10^{21}$ atoms/cm$^2$.

A gate conductive layer 70 is formed over gate semiconductive layer 68. Gate conductive layer 70 can comprise, for example, chromium. In alternative configurations, the positions of layers 68 and 70 can be switched, with gate semiconductive layer 68 being positioned over gate conductive layer 70.

Figure 7:
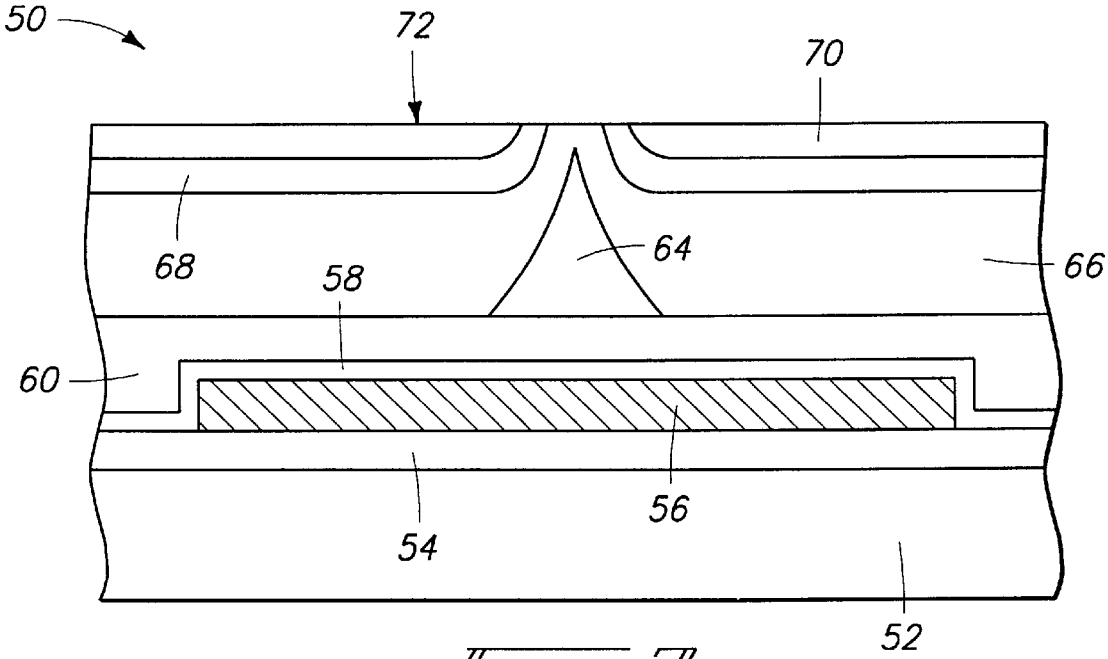
FIG. 7 is a view of the FIG. 4 baseplate assembly shown at a processing step subsequent to that of FIG. 4.

Referring to FIG. 7, layers 66, 68 and 70 are planarized to form a planarized upper surface 72. A suitable method for such planarization is chemical-mechanical planarization.

Figure 8:
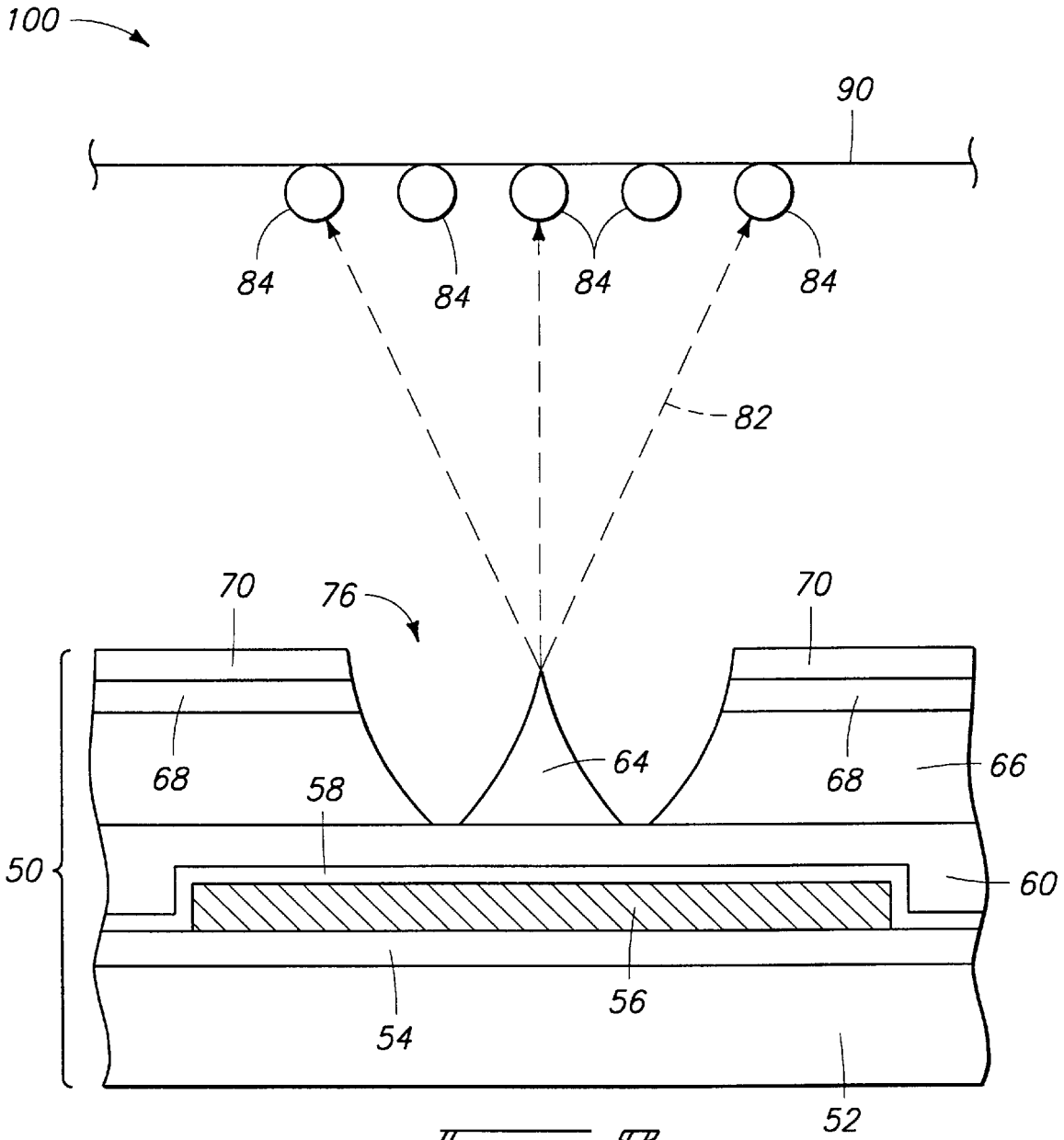
FIG. 8 is a view of the FIG. 4 baseplate assembly shown at a processing step subsequent to that of FIG. 7, and shown incorporated into an FED device.

Referring to FIG. 8, a portion of dielectric layer 66 is removed to form an aperture 76 through which electron emission tip 64 is exposed. A suitable process for removal of a portion of dielectric layer 66 is an isotropic etch. Preferably, the etch is selective for the material of layer 66 relative to the material of electron emission tip 64. Aperture 76 extends around electron emission tip 64, and electron emission tip 64 extends into aperture 76. FIG. 8 also shows portions of layers 68 and 70 removed to extend aperture 76. Such removal of layers 68 and 70 is preferably accomplished utilizing an etch selective for the material of layers 68 and 70 relative to that of tip 64.

The baseplate assembly 50 of FIG. 8 is incorporated into an FED device 100. In the shown embodiment, baseplate assembly 50 comprises a cathode conductive layer 56, buffer layer 58, resistor layer 60, electron emission tip 64, dielectric layer 66, gate semiconductive layer 68, and gate conductive layer 70. An extraction gate 74 (or gate electrode) comprises gate semiconductive layer 68 and gate conductive layer 70.

A faceplate assembly 90 is provided over baseplate assembly 50, and spaced therefrom. Faceplate assembly 90 comprises phosphor molecules 84. Methodology similar to that discussed above with reference to prior art FIG. 1 can be used to provide a charge differential between emitter 64 and phosphor molecules 84, to cause electrons 82 to be emitted from emitter tip 64 and toward phosphor molecules 84.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An electron emission device, comprising:

a substrate;

a first layer supported by the substrate, the first layer comprising a conductive material;

an electron emission tip electronically connected with the first layer; and a second layer electrically disposed between the first layer and the electron emission tip, the second layer being a buffer layer comprising microcrystalline silicon.

2. The electron emission device of claim 1 further comprising a third layer electrically disposed between the second layer and the electron emission tip, the third layer being electrically resistive.

3. The electron emission device of claim 1 further comprising a third layer wherein the second and third layers are physically disposed between the first layer and the electron emission tip.

4. The electron emission device of claim 1 wherein the second layer consists essentially of conductively-doped microcrystalline silicon.

5. The electron emission device of claim 1 wherein the first layer comprises a metal.

6. The electron emission device of claim 1 wherein the first layer comprises three sub-layers, the three sub-layers being an aluminum-containing sub-layer between two chromium-containing sub-layers.

7. The electron emission device of claim 1 further comprising a third layer electrically disposed between the second layer and the electron emission tip wherein the third layer comprises boron-doped amorphous silicon.

8. The electron emission device of claim 1 further comprising a third layer, wherein:

the first layer comprises three sub-layers, the three sub-layers being an aluminum-containing sub-layer between two chromium-containing sub-layers;

the second layer comprises conductively-doped microcrystalline silicon; and the third layer comprises boron-doped amorphous silicon.

9. The electron emission device of claim 8 wherein the second layer consists essentially of the conductively-doped microcrystalline silicon.

10. The electron emission device of claim 8 wherein the second layer consists essentially of the conductively-doped microcrystalline silicon and contacts one of the chromium-containing sub-layers.

11. A field emission display device, comprising:

a baseplate;

a first layer supported by the baseplate, the first layer comprising a conductive material;

a plurality of electron emission tips electronically connected with the first layer and supported by the baseplate;

a second layer electrically disposed between the first layer and the electron emission tips, the second layer being a buffer layer comprising microcrystalline silicon and being supported by the baseplate;

a faceplate spaced from the baseplate;

spacers between the faceplate and the baseplate and supporting the faceplate and baseplate in spaced relation to one another; and phosphor molecules supported on the faceplate and spaced from the electron emission tips.

12. The device of claim 11 further comprising a third layer electrically disposed between the second layer and the electron emission tips, the third layer being electrically resistive.

13. The device of claim 11 wherein the second and third layers are physically disposed between the first layer and the electron emission tips.

14. The device of claim 11 wherein the second layer consists essentially of conductively-doped microcrystalline silicon.

15. The device of claim 11 wherein the first layer comprises a metal.

16. The device of claim 11 wherein the first layer comprises three sub-layers, the three sub-layers being an aluminum-containing sub-layer between, two chromium-containing sub-layers.

17. The device of claim 11 wherein the third layer comprises boron-doped amorphous silicon.

18. The device of claim 11 wherein:

the first layer comprises three sub-layers, the three sub-layers being an aluminum-containing sub-layer between two chromium-containing sub-layers;

the second layer comprises conductively-doped microcrystalline silicon; and the third layer comprises boron-doped amorphous silicon.

19. The device of claim 18 wherein the second layer consists essentially of the conductively-doped microcrystalline silicon.

* * * * *